US009771664B2

(12) United States Patent
Kamachi

(10) Patent No.: US 9,771,664 B2
(45) Date of Patent: Sep. 26, 2017

(54) METHOD FOR REMOVING RARE EARTH IMPURITIES FROM NICKEL-ELECTROPLATING SOLUTION

(71) Applicant: HITACHI METALS, LTD., Tokyo (JP)

(72) Inventor: Masanao Kamachi, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/771,330

(22) PCT Filed: Mar. 17, 2014

(86) PCT No.: PCT/JP2014/057136
§ 371 (c)(1),
(2) Date: Aug. 28, 2015

(87) PCT Pub. No.: WO2014/156767
PCT Pub. Date: Oct. 2, 2014

(65) Prior Publication Data

US 2016/0002815 A1 Jan. 7, 2016

(30) Foreign Application Priority Data

Mar. 25, 2013 (JP) ..... 2013-061650

(51) Int. Cl.
*C25D 21/18* (2006.01)
*C25D 21/06* (2006.01)
*C25D 3/12* (2006.01)

(52) U.S. Cl.
CPC ..... *C25D 21/18* (2013.01); *C25D 21/06* (2013.01); *C25D 3/12* (2013.01)

(58) Field of Classification Search
CPC ..... C25D 21/18
See application file for complete search history.

(56) References Cited

U.S. PATENT DOCUMENTS 3,653,813 A * 4/1972 Chiola ..... C01G 41/00 423/263
5,037,463 A * 8/1991 Engdahl ..... B01D 9/04 62/123
2003/0226761 A1 12/2003 Featherstone et al.
(Continued)

FOREIGN PATENT DOCUMENTS

CN 101484615 A 7/2009
JP 61-533 A 1/1986
(Continued)

OTHER PUBLICATIONS

International Search Report of PCT/JP2014/057136, dated Jun. 17, 2014. [PCT/ISA/210].
(Continued)

*Primary Examiner* — Peter Keyworth
(74) *Attorney, Agent, or Firm* — Sughrue Mion, PLLC

(57) ABSTRACT

A method for removing rare earth impurities from a nickel-electroplating solution by keeping a nickel-electroplating solution containing rare earth impurities and having pH of 4.0-5.1 at 60° C. or higher for a certain period of time, and then removing precipitate generated by the heating from the nickel-electroplating solution by sedimentation and/or filtration.

3 Claims, 2 Drawing Sheets

(56) References Cited

U.S. PATENT DOCUMENTS

| | | | | |
|---|---|---|---|---|
| 2005/0232849 | A1* | 10/2005 | Shindo | C01G 3/10 423/557 |
| 2009/0078577 | A1 | 3/2009 | Suzuki et al. | |
| 2011/0120267 | A1 | 5/2011 | Roche | |
| 2012/0309614 | A1* | 12/2012 | Ohtake | B01D 53/94 502/263 |
| 2014/0224664 | A1 | 8/2014 | Kamachi | |
| 2016/0002814 | A1 | 1/2016 | Kamachi | |

FOREIGN PATENT DOCUMENTS

| | | | |
|---|---|---|---|
| JP | 2-209500 | A | 8/1990 |
| JP | 7-34300 | A | 2/1995 |
| JP | 7-62600 | A | 3/1995 |
| JP | 2002-194600 | A | 7/2002 |
| JP | 2006-77271 | A | 3/2006 |
| JP | 2008-45187 | A | 2/2008 |
| JP | 2013-173993 | A | 9/2013 |
| WO | 2013/047340 | A1 | 4/2013 |

OTHER PUBLICATIONS

Chinese Office Action dated Dec. 1, 2016, for Application No. 201480017674.0, 13 pages total.

U.S. Non-Final Office Action dated Sep. 12, 2016, issued for corresponding U.S. Appl. No. 14/346,058; 15 pages total.

Chinese Office Action dated Sep. 6, 2015, for Application No. 201280048690.7; 10 pages total.

International Search Report for International Application No. PCT/JP2014/057107 dated Jun. 17, 2014; 4 pages.

Chinese Office Action dated Dec. 1, 2016, for Application No. 201480017713.7, 13 pages total.

Linyan Li et al. "Recovery of Ni, Co and rare earths from spent Ni-metal hydride batteries and preparation of spherical $Ni(OH)_2$" Hydrometallurgy, vol. 100 (2009) (pp. 41-46).

An Office Action dated Mar. 24, 2017, which issued during the prosecution of U.S. Appl. No. 14/771,327.

A Notice of Allowance dated Mar. 27, 2017, which issued during the prosecution of U.S. Appl. No. 14/346,058.

Nakayama and Sakamoto, English Machine Translation, JP 2006-77271 A (2006), 9 pages.

* cited by examiner

METHOD FOR REMOVING RARE EARTH IMPURITIES FROM NICKEL-ELECTROPLATING SOLUTION

CROSS REFERENCE TO RELATED APPLICATIONS

This application is a National Stage of International Application No. PCT/JP2014/057136 filed Mar. 17, 2014 (claiming priority based on Japanese Patent Application No. 2013-061650, filed Mar. 25, 2013), the contents of which are incorporated herein by reference in their entirety.

FIELD OF THE INVENTION

The present invention relates to a method for removing rare earth impurities from a nickel-electroplating solution efficiently and easily.

BACKGROUND OF THE INVENTION

Rare earth magnets, particularly sintered R—Fe—B magnets (R is at least one of rare earth elements including Y, indispensably containing Nd), are widely used because of high magnetic properties, but Nd and Fe contained as main components are rusted very easily. To improve their corrosion resistance, the magnets are provided with corrosion-resistant coatings. Among them, a nickel electroplating is widely used for these magnets, because it has high hardness and is easier than electroless plating in controlling plating steps.

In the earliest growing stage of the electroplated nickel layer, components in an article to be plated may be dissolved in a plating solution. Particularly when the plating solution has pH on the acidic side, the article to be plated is easily dissolved and accumulated as impurities in the plating solution.

In the case of the sintered R—Fe—B magnets, rare earth elements such as Nd, and Fe, main components, are dissolved in the plating solution as impurities. As a result of continuous plating, rare earth impurities such as Nd, and Fe, main components of the magnets, are dissolved and accumulated in the plating solution. To conduct plating without impurities, a new plating solution should be used in every plating treatment. However, the preparation of a new plating solution in each plating treatment is substantially impossible because of production cost increase.

When the plating solution contains impurities, a nickel electroplating generally tends to suffer deteriorated gloss, insufficient adhesion to an article to be plated, burnt deposits, etc. For example, when a certain level or more of rare earth elements are accumulated as impurities in the plating solution, the resultant plating has low adhesion to a magnet body, thereby suffering peeling, and double plating (interfacial delamination) caused by intermittent current during plating.

Whether or not defects such as decreased adhesion and double plating occur depends on the composition of a plating solution, plating conditions, etc., and the inventor's experiment has revealed that when the amount of rare earth impurities (mainly Nd impurity) exceeds 700 ppm, these defects likely occur. Particularly, in barrel-type plating, the double plating likely occurs because large current locally flows through an article to be plated. Also, when the plating solution has high pH with large amounts of rare earth impurities, the double plating likely occurs.

When nickel electroplating is carried out in an industrial mass production scale, it is impractical from the aspect of production cost to keep a nickel-electroplating solution completely free from rare earth impurities, so that it is in general not used. However, it is desirable for quality control to limit the amount of rare earth impurities as small as not exceeding 700 ppm.

To remove impurities such as Fe dissolved in a nickel-electroplating solution, a method of adding a nickel compound such as nickel carbonate, etc. to a plating solution to increase its pH (activated carbon may be added simultaneously to remove organic impurities), precipitating impurities by air stirring, and then removing the impurities by filtration has conventionally been carried out. Though this method is effective to remove metal impurities such as iron, aluminum, etc., and organic impurities, which are dissolved in the nickel-electroplating solution, it is not effective to remove rare earth impurities.

In view of the above circumstances, as a method of continuously removing rare earth impurities efficiently, JP 7-62600 A discloses a method for removing rare earth impurities from a nickel-electroplating solution, with an agent used for the purification and separation of rare earth metals. This method appears to be effective as one of methods for reducing the amounts of rare earth impurities in the nickel-electroplating solution. However, this method needs complicated steps, inefficient in an industrial mass production scale, and impractically needs a special agent.

OBJECT OF THE INVENTION

Accordingly, an object of the present invention is to provide a method for removing rare earth impurities from a nickel-electroplating solution relatively easily and efficiently, without using complicated steps, and without needing a special agent.

DISCLOSURE OF THE INVENTION

As a result of intensive research in view of the above object, the inventor has found that by keeping a nickel-electroplating solution containing rare earth impurities and having pH of 4.0-5.1 at 60° C. or higher for a certain period of time, rare earth impurities can be precipitated, and easily removed by filtration. The present invention has been completed based on such finding.

The method of the present invention for removing rare earth impurities from a nickel-electroplating solution comprises keeping a nickel-electroplating solution containing rare earth impurities and having pH of 4.0-5.1, at 60° C. or higher for a certain period of time; and then removing a precipitate generated by the heating from the nickel-electroplating solution by sedimentation and/or filtration.

The nickel-electroplating solution preferably has pH of 4.0-4.5 before heating.

The nickel-electroplating solution is preferably stirred while heating.

The solution is preferably stirred by air, rotating stirring blades, or circulation by a pump.

DESCRIPTION OF THE PREFERRED EMBODIMENTS

Figure 1:
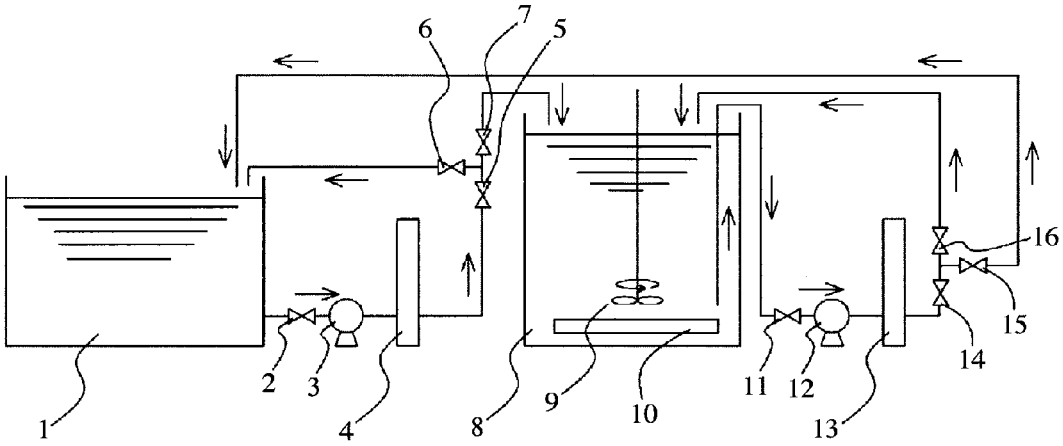
FIG. 1 is a schematic view showing an example of nickel-electroplating apparatuses for carrying out the method of the present invention for removing rare earth impurities from a nickel-electroplating solution.

The method of the present invention for removing rare earth impurities from a nickel-electroplating solution comprises keeping a nickel-electroplating solution containing rare earth impurities and having pH of 4.0-5.1 at 60° C. or higher for a certain period of time; and then removing the resultant precipitate from the nickel-electroplating solution by sedimentation and/or filtration.

In the present invention, the rare earth impurities are R components dissolved in an electroplating solution, for example, when a sintered R—Fe—B magnet (R is at least one rare earth element including Y, indispensably containing Nd) is electroplated with nickel. Because the rare earth impurities are in the form of ions in the plating solution, they are not easily collected by filtration. The present invention turns rare earth impurities in the form of ions to a solid precipitate collectable by a filtering equipment, which can be removed from the plating solution by sedimentation or filtration. It should be noted that the present invention is not restricted to the removal of an R component dissolved in the plating solution when the sintered R—Fe—B magnet is electroplated with nickel, but may be applied to the removal of rare earth impurities existing in the form of ions in the plating solution in advance.

The method of the present invention for removing rare earth impurities is effective for a nickel-electroplating solution containing rare earth impurities and having pH of 4.0-5.1. As described later, the inventor has confirmed that by keeping the nickel-electroplating solution containing rare earth impurities at 60° C. or higher for a certain period of time, rare earth impurities in the form of ions can be turned to a solid precipitate, and that this precipitate is formed at substantially the same speed as long as the pH is within the above range, thereby achieving the efficient removal of rare earth impurities.

Because the nickel-electroplating solution having pH of 4.0-5.1 is substantially the same in pH as plating solutions used in known nickel electroplating (for example, plating using a Watts bath composition) of sintered R—Fe—B magnets, the plating solution of the present invention after removing rare earth impurities need not be adjusted in pH, when newly used for the nickel electroplating of sintered R—Fe—B magnets.

The above heating treatment may be carried out, after the nickel-electroplating solution containing rare earth impurities, which has pH outside the above range, is adjusted to have pH within the above range. Known pH adjustment, such as the addition of nickel carbonate to increase pH, and the addition of sulfuric acid to decrease pH, may be used. However, pH adjustment by the addition of nickel carbonate or sulfuric acid results in plating cost increase, and treatment efficiency decrease (particularly, nickel carbonate is not easily dissolved in the plating solution). The effects of the present invention can be achieved most effectively, when the nickel-electroplating solution containing rare earth impurities and having pH in a range of 4.0-5.1 is heat-treated without pH adjustment. Accordingly, it is desirable to periodically measure the pH of the plating solution during operation, and to carry out the present invention with the pH kept in the above range.

The nickel-electroplating solution containing rare earth impurities, to which the present invention is applied, has pH preferably in a range of 4.0-5.1 without such pH adjustment as described above, more preferably within the range (for example, 4.0-4.5) of a practical plating solution.

The nickel-electroplating solution containing rare earth impurities and having the above pH should be heated at 60° C. or higher to remove rare earth impurities. At lower than 60° C., it takes too much time to remove rare earth impurities, not suitable for industrial production. A higher solution temperature tends to provide more efficient removal of rare earth impurities (precipitate). Though not particularly restrictive, the upper limit of the solution temperature is desirably lower than the boiling point of the plating solution, from the aspect of operability and safety, as well as influence on the composition of the plating solution, etc.

When the plating solution is heated to its boiling point or higher, water is rapidly evaporated from the plating solution, resulting in the rapid precipitation of components in the plating solution. The boiling point of the plating solution may vary depending on its composition, and for example, the boiling point of a Watts bath is about 102° C. Because the boiling point of the plating solution is elevated as its molar boiling point is elevated, the boiling points of any plating solutions having different compositions can be controlled in the removal of impurities, with 100° C. as their upper limits, the boiling point of water. Thus, in the method of the present invention, heating is preferably in a range of 60° C. to 100° C., more preferably in a range of 70° C. to 95° C., most preferably in a range of 80° C. to 90° C.

Though variable depending on the temperature, the treatment time is preferably 6 hours or more, more preferably 12 hours or more. Though not particularly necessary, the upper limit of the treatment time is preferably 168 hours or less, more preferably 72 hours or less, most preferably 24 hours or less, from the aspect of cost and operation efficiency.

The relation between the amount of rare earth impurities (particularly Nd impurity) and the occurrence of double plating and the peeling of a plating film may vary depending on the plating conditions, but such problems do not occur when the amount of Nd impurity is about 200 ppm. Accordingly, the above temperature and time are properly set to reduce the amount of Nd impurity to 200 ppm or less.

However, a longer heating time (keeping time) needs more preliminary baths for removing impurities from the plating solution. Accordingly, when there is a facility capable of heating the plating solution to 90° C. or higher, the amount of the impurity can be reduced to 100 ppm or less in 24-48 hours.

Because a bath used in the method of the present invention for removing rare earth impurities should have high heat resistance in the above heating range (heating temperature of the plating solution), a higher heating temperature inevitably results in a higher cost. Carrying out the method in the above temperature range, particularly in the preferable temperature range contributes to the suppression of cost increase.

When the method of the present invention for removing rare earth impurities is carried out, the concentration of the plating solution is desirably 1-3 times that of the plating solution when plating is conducted. The plating solution is desirably concentrated by heating. Because water (solvent) is evaporated from the plating solution by heating, heating and concentrating can be conducted simultaneously.

When the plating solution is concentrated by heating, a higher temperature is preferable within the heating temperature range of the present invention, because it can shorten a necessary concentrating time. When the plating solution is concentrated more than 3 times by heating, components start to be precipitated in the plating solution undesirably rapidly. The concentration is more preferably 1-2 times. Though the treatment can be conducted even with a concentration of 2-3 times, control should be carefully conducted to avoid the precipitation of plating solution components from starting, when the concentration is near 3 times.

To keep the amount of the plating solution constant when heating, water should be supplemented. For example, when a heater is exposed from a surface of the plating solution lowering by concentration, the heater may be broken. In such case, water is desirably supplemented to keep a constant concentration. To keep the concentration of the plating solution constant, concentration adjustment can be conducted in a short period of time by supplementing water to a plating solution stored after the removal of impurities and sent to a plating bath.

As described above, the present invention is suitable for removing rare earth impurities from a nickel-plating solution in a predetermined pH range. The present invention is applicable to such nickel-plating solutions as a Watts bath, a high-chloride bath, a chloride bath, a sulfamic acid bath, etc., and it is most suitable for the Watts bath. The Watts bath may have a general composition. For example, it is applicable to a composition comprising 200-320 g/L of nickel sulfate, 40-50 g/L of nickel chloride, and 30-45 g/L of boric acid, as well as a glossing agent and a pit inhibitor as additives.

The composition adjustment of the plating solution uses a known analysis method (titration analysis, etc.). For example, in the case of a Watts bath, the amounts of nickel chloride and the entire nickel are analyzed by titration to determine the amount of nickel sulfate, and the amount of boric acid is analyzed by titration.

In the present invention, the composition of the plating solution is adjusted by supplementing nickel sulfate, nickel chloride, and boric acid, when they are insufficient in the plating solution after removing rare earth impurities. When these agents are added, the plating solution is desirably heated to a temperature at which plating is conducted. At a low temperature, the agents added are not or too slowly dissolved. Thereafter, the pH is adjusted by nickel carbonate or sulfuric acid, and known glossing agent and pit inhibitor are added for a plating treatment.

Plating conditions using the plating solution of the present invention may be properly changed, depending on the plating facility, the plating method, the size and number of articles to be plated, etc. For example, when a Watts plating bath having the above composition is used, the pH is preferably 3.8-4.5, more preferably 4.0-4.5. At low pH, rare earth magnets are undesirably dissolved at an early stage of nickel electroplating. The bath temperature is preferably 45-55° C., and the current density is preferably 0.1-10 $A/dm^2$. The plating method may be rack-type or barrel-type, and may be properly set depending on the size and number of articles to be plated.

According to the present invention, a plating bath formed by FRP or PP having high heat resistance, or a fluororesin-coated iron plate can remove impurities from the nickel-electroplating solution without using a preliminary bath. Impurities can be removed in a preliminary bath formed by a material having high heat resistance, and plating can be conducted in a plating bath formed by polyvinyl chloride (PVC), resulting in improved efficiency and operability. Containers formed by a material having high heat resistance can be used for both plating bath and preliminary bath, for improved safety.

A plating bath and a preliminary bath used for removing rare earth impurities will be explained referring to FIG. 1.

The plating bath 1 comprising an anode plate (not shown), a cathode plate (not shown), a heater (not shown) and a stirrer (not shown) can form a plating solution to carry out nickel electroplating. Though variable depending on the plating solution, a material for the plating bath 1 is preferably polyvinyl chloride (PVC) or heat-resistant polyvinyl chloride (PVC).

A first filtration system is constituted by a plating bath 1, valves 2, 5, 6, 7, a pump 3, and a filtering equipment 4. With the valve 7 closed, and the valves 2, 5, 6 open, the pump 3 is operated to circulate a plating solution in the plating bath 1 through the filtering equipment 4 for filtration. Namely, the plating solution is circulated through the plating bath 1, the valve 2, the pump 3, the filtering equipment 4, the valve 5, and the valve 6, and filtered by the filtering equipment 4. The filtering equipment 4 may use a known filter for electroplating, and may be integrally combined with the pump 3. A pipe material is preferably polyvinyl chloride (PVC) or heat-resistant polyvinyl chloride (PVC).

The preliminary bath 8 comprises stirring blades 9 connected to a motor (not shown), and a heater 10 connected to a power supply (not shown). The heater 10 may be a steam heater connected to a vapor-generating apparatus through a pipe. As a stirring means of the plating solution in the preliminary bath, an air-bubbling pipe connected to an air pump, or circulation by a pump 12 as described below may be used in place of the stirring blades 9. To treat a high-temperature plating solution containing rare earth impurities, the preliminary bath 8 is preferably formed by PP or FRP having high heat resistance.

A second filtration system is constituted by the preliminary bath 8, valves 11, 14, 15, 16, a pump 12, and a filtering equipment 13. The filtering equipment 13 may be integrally combined with the pump 12.

The circulation of the plating solution through the preliminary bath, and the supply of the plating solution between the preliminary bath and the plating bath will be explained below. With the valve 6 closed, and the valves 2, 5, 7 open, the pump 3 is operated to supply the plating solution from the plating bath 1 to the preliminary bath 8 through the filtering equipment 4. Namely, the plating solution is sent from the plating bath 1 to the preliminary bath 8, through the valve 2, the pump 3, the filtering equipment 4, the valve 5, and the valve 7.

With the valve 15 closed, and the valves 11, 14, 16 open, the pump 12 is operated to circulate the plating solution in the preliminary bath 8 through the filtering equipment 13 for filtration. Namely, the plating solution is circulated through the preliminary bath 8, the valve 11, and the pump 12, the filtering equipment 13, the valve 14, and the valve 16, and filtered by the filtering equipment 13.

With the valve 16 closed, and the valves 11, 14, 15 open, the pump 12 is operated to circulate the plating solution from the preliminary bath 8 to the plating bath 1 via the filtering equipment 13. Namely, the plating solution is circulated through the preliminary bath 8, the valve 11, the pump 12, the filtering equipment 13, the valve 14, the valve 15, and the plating bath 1.

The plating solution is heat-treated in the preliminary bath 8 to precipitate rare earth impurities. The precipitated rare earth impurities are sedimented on a bottom of the preliminary bath 8, when stirring by the stirring blades 9 is stopped. After the precipitate is sedimented, the plating solution is sent from the preliminary bath 8 to the plating bath 1 through the valve 11, the pump 12, the filtering equipment 13, the valve 14, and the valve 15, so that the clogging of a filter with the precipitate is so suppressed that the filter in the filtering equipment 13 can be used for a long period of time.

Because a tip end (sucking the plating solution) of a pipe connecting the preliminary bath 8 to the pump 12 via the valve 11 is not in contact with the bottom of the preliminary bath 8, the precipitate accumulated on the bottom is substantially not sucked.

When the plating solution containing the precipitation generated by heating is quickly sent to the plating bath 1, it is unnecessary to wait sedimentation.

When the plating solution after sedimenting the precipitate is sent from the preliminary bath 8 to the plating bath 1, the filtering equipment 13 may not be provided with a filter. The sufficiently sedimented precipitate is accumulated on the bottom of the preliminary bath 8, so that the plating solution sent from the preliminary bath 8 to the plating bath 1 contains extremely small amounts of precipitate. Accordingly, after sent to plating bath 1, the remaining precipitate can be removed from the plating solution, in the filtration step of the plating solution in the plating bath 1 through a path comprising the plating bath 1, the valve 2, the pump 3, the filtering equipment 4, the valve 5 and the valve 6.

The present invention can be carried out not only by the above apparatus, but also by apparatuses having various structures. For example, a pipe for circulating the plating solution in the plating bath 1, and a pipe for sending the plating solution from the plating bath 1 to the preliminary bath 8 may be independently provided. A specific structure comprising valves, a pump and a filtering equipment connected to the plating bath 1 will be explained below.

As described above, with the valve 7 closed, and the valves 2, 5, 6 open, the pump 3 is operated to circulate the plating solution through the plating bath 1, the valve 2, the pump 3, the filtering equipment 4, the valve 5, and the valve 6. With the valve 6 closed, and the valves 2, 5, 7 open, the pump 3 is operated to send the plating solution from the plating bath 1 to the preliminary bath 8, through the valve 2, the pump 3, the filtering equipment 4, the valve 5, and the valve 7. By opening and closing the valves 5, 6, 7, circulation through the plating bath 1 and supply from the plating bath 1 to the preliminary bath 8 are switched. In this case, a path through the valve 2, the pump 3, the filtering equipment 4 and the valve 5 is commonly used in circulation and supply.

The above common portions may be independent. One pipe for circulation passes through the valve 2, the pump 3, the filtering equipment 4, the valve 5, the valve 6, and the plating bath 1 (the valves 5 and 6 are not indispensable), and another pipe passes through the valve 2', the pump 3', the filtering equipment 4', the valve 5', the valve 7, and the preliminary bath 8 (the valve 5' and 7 are not indispensable). With such structure, the circulation and supply of the plating solution can be conducted through simple paths, avoiding the malfunctions of the valves, etc. In the pipe for circulating the plating solution through the preliminary bath 8, and the pipe for supplying the plating solution from the preliminary bath 8 to the plating bath 1, common portions may be similarly independent to obtain the same effects as described above.

Figure 2:
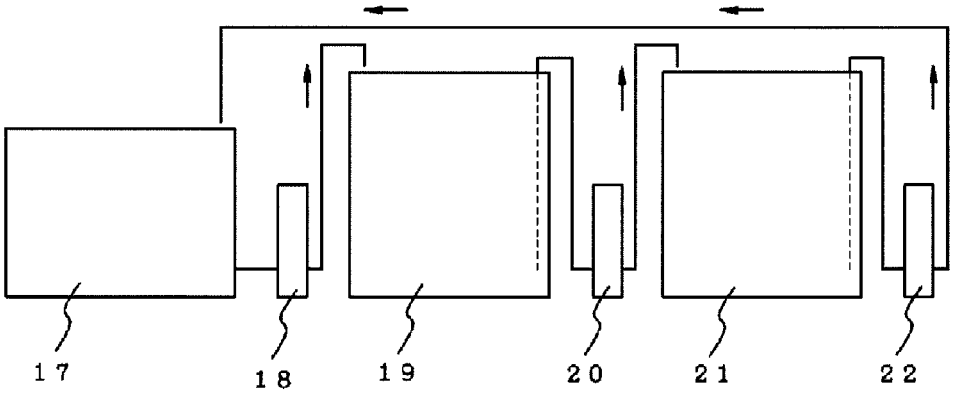
FIG. 2 is a schematic view showing another example of nickel-electroplating apparatuses for carrying out the method of the present invention for removing rare earth impurities from a nickel-electroplating solution.

FIG. 2 shows a structure comprising another preliminary bath added to the system shown in FIG. 1, which comprises a plating bath and a preliminary bath. In FIG. 2 mainly explaining the functions of the plating bath and the preliminary bath, a heater and stirring blades in each preliminary bath, and electrodes, etc. in the plating bath are not shown. Only pipes for supplying the plating solution between the preliminary baths and between these preliminary baths and the plating bath are shown, with valves and circulation pipes omitted.

Each preliminary bath having a heater (and stirring blades) can heat the nickel-electroplating solution to accelerate the precipitation of rare earth impurities. For example, after the plating solution containing rare earth impurities is sent to a first preliminary bath 19, a plating solution containing a reduced amount of rare earth impurities, if any, which is stored in a second preliminary bath 21, is sent to the plating bath 17, thereby making it possible to shorten a plating-waiting time in the plating bath 17.

It is possible to carry out a multi-stage removal of rare earth impurities, for example, by removing rare earth impurities by half of the target amount from the plating solution in the first preliminary bath 19, sending the plating solution to the second preliminary bath 21, and then further removing rare earth impurities to the target amount, etc. Thus, the amount of rare earth impurities removed can be set depending on the treatment capacity of each preliminary bath 19, 21, resulting in improved practical use on an industrial scale.

In the present invention, after the precipitated rare earth impurities are separated from the nickel-electroplating solution, or when the nickel-electroplating solution is sent to the plating bath simultaneously with filtration by the filtering equipment, the nickel-electroplating solution is desirably cooled to a temperature equal to or lower than its treatment temperature. When the sent nickel-electroplating solution is at a higher temperature than its treatment temperature, a nickel film electroplated at such a temperature may have deteriorated properties. Because a nickel-electroplating bath usually comprises a heating means such as a heater, etc., the sent nickel-electroplating solution can be adjusted to have a treatment temperature by heating even though its temperature is lower than the treatment temperature. However, when the nickel-electroplating solution is at a higher temperature than the treatment temperature, a cooling means should be added to the plating bath, resulting in cost increase, and cooling time is needed, resulting in decreased plating efficiency. When the plating bath is made of a material having low heat resistance, it may be deformed by a high-temperature plating solution. The nickel-electroplating solution may be spontaneously cooled, after heating for the precipitation of rare earth impurities is stopped. For rapid cooling, a heat exchanger for cooling or a chiller may be used.

The present invention will be explained in more detail by Examples below without intention of restricting the scope of this invention.

Example 1

A plating solution having a composition comprising 250 g/L of nickel sulfate, 50 g/L of nickel chloride, and 45 g/L of boric acid, and having pH of 4.5 was heated to 50° C., to carry out nickel electroplating on several types of sintered R—Fe—B magnets, which were adjusted to have compositions comprising 15-25% by mass of Nd, 4-7% by mass of Pr, 0-10% by mass of Dy, 0.6-1.8% by mass of B, and 0.07-1.2% by mass of Al, the balance being Fe (containing 3% or less by mass of Cu and Ga), depending on necessary magnetic properties. Magnets having the same composition were used in each batch. The composition and amount of rare earth impurities dissolved in the plating solution may vary depending on the magnets to be plated, treatment methods such as barrel plating and rack plating, and the composition of the plating solution.

After plating for several days, Nd, Pr and Dy as impurities in the nickel-electroplating solution were analyzed by an ICP atomic emission spectrometer. Analysis indicates that the used plating solution contained 500 ppm of Nd, 179 ppm of Pr, and 29 ppm of Dy. This plating solution had pH of 4.5.

3 liters of a plating solution containing the above rare earth impurities was charged into a beaker, and kept at 90° C. by a heater for a certain period of time. During heating, water was supplemented while stirring with a magnet stirrer, to keep the concentration of the plating solution constant.

After 24 hours and 96 hours passed, each plating solution in a necessary amount for ICP atomic emission spectroscopy was filtered by a filter paper, and the concentrations of Nd, Pr and Dy in the plating solution were measured by an ICP atomic emission spectrometer. Analysis results were 100 ppm of Nd, 35 ppm of Pr, and 16 ppm of Dy after 24 hours, and 50 ppm of Nd, 16 ppm of Pr, and 2 ppm of Dy after 96 hours.

As described above, rare earth impurities dissolved in the form of ions in a nickel-electroplating solution were turned to precipitates by heating for a predetermined period of time, and removed from the plating solution by filtration with a filter paper. Rare earth impurities which were not turned to precipitates by heating for a predetermined period of time remained in the plating solution in the form of ions in proportions shown by the above analysis. The above analysis indicates that a longer heating time provided more rare earth impurities removed as precipitates, and less rare earth impurities remaining in the form of ions in the plating solution. The treatment of Example 1 decreased not only Nd but also Pr and Dy as rare earth impurities.

Example 2

A plating solution having a composition comprising 250 g/L of nickel sulfate, 50 g/L of nickel chloride and 45 g/L of boric acid, and having pH of 4.5 was heated to 50° C., to carry out nickel electroplating on sintered R—Fe—B magnets in the same composition range as in Example 1. In analysis after plating for several days, the amount of Nd impurity in the nickel-electroplating solution was 576 ppm.

Figure 3:
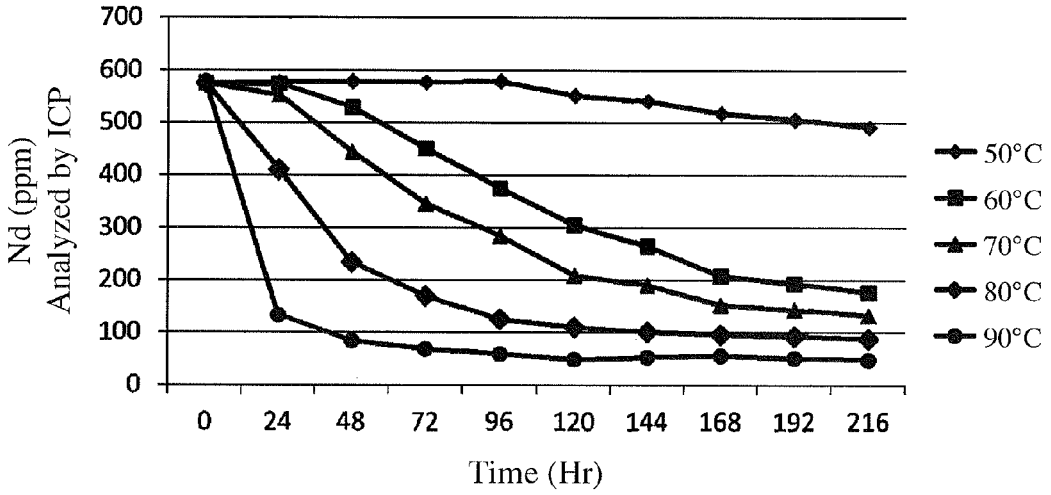
FIG. 3 is a graph showing the amount of Nd as a rare earth impurity in the filtered plating solution, which was measured by an ICP atomic emission spectrometer, and plotted against time at each keeping temperature.

The plating solution subjected to the above treatment was heated under six conditions from 50° C. to 95° C. (five conditions between 50° C. and 90° C. by 10° C. interval), and 3 liters of a plating solution under each condition was kept in a beaker. The plating solution was stirred with a magnet stirrer, while heating. During heating, water was supplemented to keep the concentration of the plating solution constant, and each plating solution in a sufficient amount for ICP atomic emission spectroscopy was taken with a constant interval, and filtered with a filter paper. The filtered plating solution was analyzed with respect to the concentration of Nd impurity by an ICP atomic emission spectrometer. The analysis results from 50° C. to 90° C. are shown in Table 1 and FIG. 3.

TABLE 1

| Temperature of Solution | Amount (ppm) of Nd Impurity at Each Lapsed Time | | | | |
|---|---|---|---|---|---|
| | 0 hr | 24 hr | 48 hr | 72 hr | 96 hr |
| 50° C. | 576 | 578 | 579 | 578 | 579 |
| 60° C. | 576 | 575 | 529 | 450 | 374 |
| 70° C. | 576 | 553 | 443 | 346 | 284 |
| 80° C. | 576 | 410 | 234 | 170 | 125 |
| 90° C. | 576 | 134 | 84 | 69 | 59 |
| 95° C. | 576 | 130 | — | — | 52 |

TABLE 1

(Continued)

| Temperature of Solution | Amount (ppm) of Nd Impurity at Each Lapsed Time | | | | |
|---|---|---|---|---|---|
| | 120 hr | 144 hr | 168 hr | 192 hr | 216 hr |
| 50° C. | 552 | 541 | 518 | 506 | 491 |
| 60° C. | 305 | 265 | 208 | 193 | 177 |
| 70° C. | 209 | 190 | 153 | 144 | 133 |
| 80° C. | 110 | 101 | 96 | 93 | 88 |
| 90° C. | 49 | 53 | 56 | 52 | 48 |
| 95° C. | — | — | — | — | — |

When the solution temperature was 50° C., the concentration of Nd impurity was 518 ppm after 168 hours. At the solution temperature of 60° C., the concentration of Nd impurity lowered after 24 hours, and became 177 ppm after 216 hours. The concentration of Nd impurity was always lower at the solution temperature of 70° C. than at 60° C., after 24 hours. At the solution temperature of 80° C., the concentration of Nd impurity was lowered immediately after heating, and became 125 ppm after 96 hours. At the solution temperature of 90° C., the concentration of Nd impurity was lowered to 134 ppm after 24 hours, 84 ppm after 48 hours, and 59 ppm after 96 hours. Analysis after 24 hours and 96 hours revealed that the concentration of Nd impurity did not substantially change at the solution temperatures of 90° C. and 95° C.

The above results revealed that in the plating solution heated to 60° C. or higher for a certain period of time, and then filtered to remove precipitates, the amount of Nd impurity was reduced, and that a higher heating temperature provided larger reducing effects.

When the amount of Nd impurity is to be reduced to 200 ppm or less, at which double plating and the peeling of a plating film do not occur, it has been found that it is reduced to about 200 ppm in a week (168 hours) at a heating temperature of 60° C., and that substantially the same effects are obtained in 5 days (120 hours) at 70° C., in 3 days (72 hours) at 80° C., and in 24 hours (one day) at 90° C. and 95° C. Accordingly, for example, with one week as a unit production period, a plating solution kept at 60° C. for a week (168 hours) and then filtered is fully usable for plating, and the amount of the impurity can be reduced to a plating-enabling level in 5 days (120 hours) at 70° C. Similarly, at 80° C., 90° C. and 95° C., the amounts of impurities in the plating solution can be reduced in a shorter period of time. Namely, the heating temperature and the keeping time can be selected depending on the presence of a facility of heating the plating solution to the above temperature, and a production schedule.

Example 3

The plating solution heat-treated in Examples 1 and 2 was filtered with a filter paper to obtain a precipitate, which was dried in a thermostatic chamber. Energy-dispersive X-ray spectroscopy (EDX) revealed that this precipitate in the form of powder (solid) had a composition comprising by mass 32.532% of Nd, 11.967% of Pr, 1.581% of Dy, 0.402% of Al, 7.986% of Ni, 0.319% of C, and 45.213% of 0. It was confirmed from this result that rare earth impurities in the plating solution were precipitated in the form of powder (solid) by the heat treatment.

Example 4

A plating solution having a composition comprising 250 g/L of nickel sulfate, 50 g/L of nickel chloride and 45 g/L of boric acid, and having pH of 4.5 was heated to 50° C., to carry out nickel electroplating on sintered R—Fe—B magnets in the same composition range as in Example 1. By analysis after plating for several days, the amount of Nd impurity in the nickel-electroplating solution was 544 ppm.

The plating solution containing the above impurity was dispensed 3 liters each to five beakers, and the pH of the plating solution was adjusted to 4.0 with sulfuric acid (two samples), and to 5.1 with nickel carbonate (two samples), and one sample was not adjusted (pH: 4.5).

Figure 4:
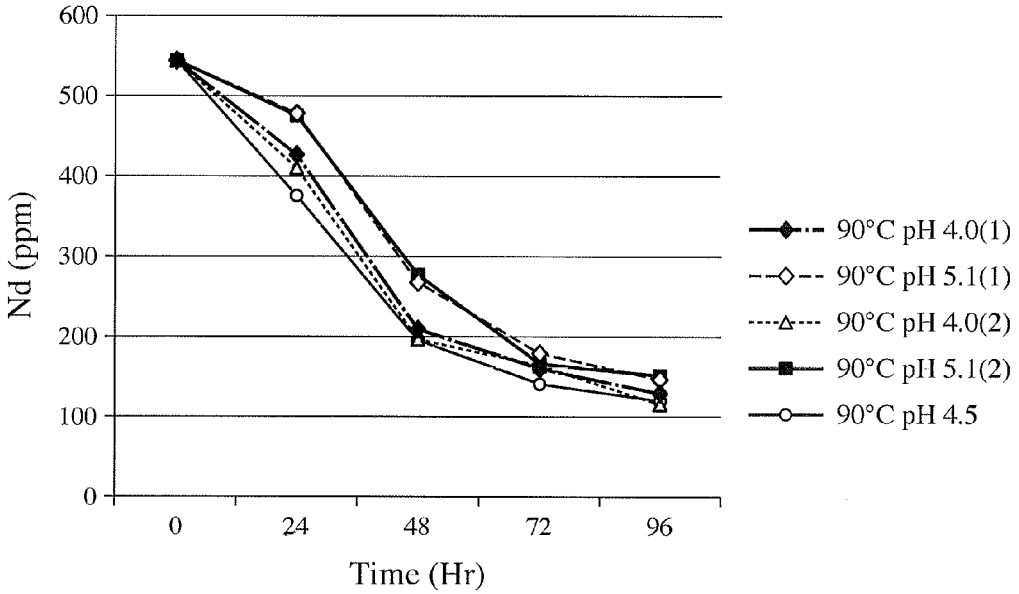
FIG. 4 is a graph showing the amount of Nd as a rare earth impurity in the filtered plating solution, which was measured by an ICP atomic emission spectrometer, and plotted against time at each pH.

Each sample was kept at 90° C. for a certain period of time. During heating, water was supplemented while stirring with a magnet stirrer, to keep the concentration of the plating solution constant. The plating solution in a necessary amount for ICP atomic emission spectroscopy was taken at each time when 24 hours, 48 hours, 72 hours and 96 hours passed, and filtered with a filter paper to measure the amount of Nd in the plating solution by an ICP atomic emission spectrometer. The results are shown in Table 2 and FIG. 4.

TABLE 2

| | Amount (ppm) of Nd Impurity at Each Lapsed Time | | | | |
|---|---|---|---|---|---|
| pH | 0 hr | 24 hr | 48 hr | 72 hr | 96 hr |
| 4.0 (1) | 544 | 426 | 209 | 160 | 129 |
| 4.0 (2) | 544 | 410 | 197 | 164 | 115 |
| 4.5 | 544 | 375 | 196 | 141 | 119 |
| 5.1 (1) | 544 | 477 | 267 | 179 | 147 |
| 5.1 (2) | 544 | 475 | 276 | 167 | 151 |

Though samples having pH of 5.1 had slightly low precipitation speeds of Nd impurity, the amount of Nd impurity decreased with time, and reached substantially the same level when 96 hours passed, in any samples. It was thus found that in the removal of rare earth impurities from the nickel-electroplating solution by heating, the precipitation speed of Nd impurity did not change remarkably, when the plating solution had pH in a range of 4.0-5.1, resulting in practically sufficient precipitation and removal of rare earth impurities. Accordingly, as long as the pH of the nickel electroplating is in a range of 4.0-5.1, rare earth impurities can be removed without pH adjustment. Namely, the adjustment of pH (increasing pH), which is conventionally conducted in many cases in removing metal impurities from nickel-electroplating solutions, is unnecessary, resulting in cost reduction and improved operation efficiency.

The effects of reducing impurities such as Nd, Pr and Dy were confirmed by Examples above, and it may be presumed that Tb and other rare earth impurities, as well as Fe impurity and Cu impurity, in the plating solution can also be decreased.

EFFECT OF THE INVENTION

According to the present invention, rare earth impurities can be removed from a nickel-electroplating solution relatively easily and efficiently, without using complicated steps and special agents, thereby enabling the electroplating of nickel particularly on sintered R—Fe—B magnets with stable quality and low cost.

The present invention is industrially useful, because plating-defects-causing rare earth impurities dissolved in a nickel-electroplating solution during plating rare earth magnets can be removed from the plating solution efficiently.

What is claimed is:

1. A method for removing rare earth impurities from a nickel-electroplating solution, consisting essentially of keeping a nickel-electroplating solution containing rare earth impurities and having pH of 4.0-4.5 without pH adjustment with heating at 60° C. or higher for 6 hours or more; and then removing a precipitate generated by said heating from said nickel-electroplating solution by sedimentation and/or filtration.

2. The method for removing rare earth impurities from a nickel-electroplating solution according to claim 1, wherein said nickel-electroplating solution is stirred while heating.

3. The method for removing rare earth impurities from a nickel-electroplating solution according to claim 2, wherein the solution is stirred by air, rotating stirring blades, or circulation by a pump.

* * * * *